US012259202B1

(12) United States Patent
Ma

(10) Patent No.: US 12,259,202 B1
(45) Date of Patent: Mar. 25, 2025

(54) MAGAZINE AND INTELLIGENT APPROVAL SYSTEM THEREOF

(71) Applicant: Yutao Ma, Flushing, NY (US)

(72) Inventor: Yutao Ma, Flushing, NY (US)

( * ) Notice: Subject to any disclaimer, the term of this patent is extended or adjusted under 35 U.S.C. 154(b) by 0 days.

(21) Appl. No.: 18/544,412

(22) Filed: Dec. 18, 2023

(51) Int. Cl.
*F41A 17/34* (2006.01)
*F41A 9/66* (2006.01)
*F41A 17/06* (2006.01)

(52) U.S. Cl.
CPC ..... *F41A 17/34* (2013.01); *F41A 9/66* (2013.01); *F41A 17/063* (2013.01); *F41A 17/066* (2013.01)

(58) Field of Classification Search
CPC ..... F41A 17/34; F41A 17/063; F41A 17/066; F41A 9/66; F41A 9/65
See application file for complete search history.

(56) References Cited

U.S. PATENT DOCUMENTS 2,515,809 A * 7/1950 Sunden ..... F41A 9/65 42/50
5,461,811 A * 10/1995 Ciener ..... F41A 9/65 42/49.02
6,412,207 B1 * 7/2002 Crye ..... F41A 17/02 42/70.08
6,477,801 B1 * 11/2002 O'dwyer ..... F41A 17/066 42/70.11
8,322,065 B2 * 12/2012 Faifer ..... F41A 9/63 42/90
10,094,630 B1 * 10/2018 Loveday, IV ..... F41A 9/65
2010/0251590 A1 * 10/2010 Fitzpatrick ..... F41A 9/65 42/50
2016/0209140 A1 * 7/2016 Toth ..... F41A 9/65
2016/0252317 A1 * 9/2016 Biran ..... F41A 17/066 42/1.01
2017/0146309 A1 * 5/2017 Biran ..... F41A 17/38
2017/0146310 A1 * 5/2017 Biran ..... F41A 17/066
2018/0066910 A1 * 3/2018 Biran ..... F41A 17/46
2020/0400398 A1 * 12/2020 Dulude ..... F41A 9/65

* cited by examiner

*Primary Examiner* — Joshua E Freeman
(74) *Attorney, Agent, or Firm* — Leong C. Lei

(57) ABSTRACT

Provided are a magazine and an intelligent approval system thereof, including: a cartridge chamber having an upper end formed with a cartridge opening and an interior for receiving cartridges loaded therein; a magazine spring located at a bottom of the cartridge chamber; a magazine follower located on the magazine spring; a casing enclosing the cartridge chamber, the magazine spring, and the magazine follower; and a locking mechanism arranged between a sidewall of the cartridge chamber and the casing and operable to block and lock the cartridge opening so as to block loading and outputting of the cartridge. The main structure is such that the magazine is provided with a locking mechanism to serve as an execution unit and is also provided with a control module for implementing intelligent control of the magazine. To use, fingerprint comparison and facial recognition are applied to realize dedicated personal use of the magazine.

10 Claims, 13 Drawing Sheets

MAGAZINE AND INTELLIGENT APPROVAL SYSTEM THEREOF

BACKGROUND OF THE INVENTION

(a) Technical Field of the Invention

The present invention relates to the field of firearms, and more particularly to a magazine featuring cartridge locking, positioning, and recording, and an intelligent approval system thereof.

(b) Description of the Prior Art

Today, according to statistics of US official publication, around one hundred thousand innocent people are shot by guns in the US every year, and more thirty thousand people are killed. On average, almost one hundred innocent people are killed by guns every day. The Centers for Disease Control and Prevention (CDC) reported that in 2021, there were 11,078 gun homicide cases in the States. This is higher than the statistical data of the Federal Bureau of Investigation (FBI). The CDC also reported that in 2018, there were 14,414 gun homicide cases (4.4 cases per one hundred thousand people) and also reported that in 2019, there were 19,141 homicide cases (5.8 cases per one hundred thousand people). A new analysis on data of CDC reveals that in 2021, firearm related deaths of children are 4,752, exceeding the total number of record for the first year of pandemic.

Although recently, control has been increased, yet it is still impossible to stop gun shooting events. In the official statistics of 2022, at least 607 large-scale gun shooting events occurred in the States, causing deaths of more than fifteen thousand people, and the actual number of people killed by firearms would be even higher. Due to the policy of the States, it is not possible to put an end to the use of firearms.

Today, although certain ways are taken to control firearms, it is still not possible to prevent firearms from being stolen and used by other people. And, also, such other people may easily erase any evidence after such uses, making it hard to identify any criminal record of the firearms, and also making it impossible to identify the true users of the firearms. This is one major factor that gun shooting cannot be restricted.

For the domestic market, although firearm control is more server, events related to firearms lost or stolen are often reported. Gun shooting may easily happen once guns are lost, and it is hard to search and find the guns once they are lost or stolen. This would cause panic to the public.

Thus, it is now desired to provide an intelligent shot approval magazine that fulfills the following effects with respect to the above issues:

(1) With respect to firearm related violence events, achieving control and management of use of firearms can be achieved.

(2) Preventing firearms from being stolen and used by other people for achieving a single-person single-gun use effect.

(3) Adding a function of black box for recording and positioning and restoring the criminal scene and also helping search and find of firearms.

(4) Adopting a magazine replacement mode for the existing firearms, without modifying the firearm structure.

(5) Banning owners of unregistered and unlicensed firearms from purchasing magazines, otherwise no purchase of cartridge is possible, if the above solution has been massively adopted in the market.

SUMMARY OF THE INVENTION

The objective of the present invention is to provide an intelligent shot approval magazine, which, for the US market where firearms can be used freely, helps suppress gun shooting events and provides more control to firearms, as being opposite to the current way of registration control that may induce occurrence of gun shooting and hurting events once firearms are stolen and used to conduct events of maliciously harming people and the firearms, once stolen, cannot be found and recovered shortly, resulting in occurrence of gun shooting events.

In view of the above drawbacks, the present invention provides a magazine and an intelligent approval system thereof, comprising: a cartridge chamber, which has an upper end in which a cartridge opening is formed, the cartridge chamber receiving a plurality of cartridges loaded in an interior thereof; a magazine spring, which is located at a bottom position of the cartridge chamber; a magazine follower, which is located at an upper end position of the magazine spring; a casing, which encloses the cartridge chamber, the magazine spring, and the magazine follower; and a locking mechanism, which is arranged on a sidewall of the cartridge chamber and between the casing, the locking mechanism being operable to block and lock the cartridge opening, so as to prevent loading and outputting of the cartridges. The present invention manages control of cartridges to realize use in a single-firearm single-individual fashion. The main structure is such that the magazine is provided with a locking mechanism to serve as an execution unit and is also provided with a control module, the control module implementing intelligent control of the magazine. To use, fingerprint comparison and facial recognition are applied to realize dedicated personal use of the magazine.

Compared with the existing technology, the advantageous efficacy of the present invention is that the present device adopts a more advanced way of intelligent control to manage and control cartridges to realize use in a single-firearm single-individual fashion. The main structure is such that the magazine is provided with a locking mechanism to serve as an execution unit and is also provided with a control module, the control module implementing intelligent control of the magazine. To use, fingerprint comparison and facial recognition are applied to realize dedicated personal use of the magazine, so that even the firearm magazine is stolen, the other persons are incapable of opening the magazine and are thus incapable of shooting, and also, the control module is provided with a function of positioning and a function of sound recording, making it possible to fulfill real-time monitoring for the magazine for monitoring the location and the use situation of the magazine when put into use, so as to, on the one hand, ease search and retrieval of the magazine after being stolen, and to, on the other hand, record the situation of use to determine if the user commits violating behavior. Consequently, as a whole, it is possible to manage and control malicious hurting of people after the firearm is stolen, and also timely the user maliciously hurting people, with the recording made in the magazine, evidence can be provided to consequently manage and control user crimes.

DETAILED DESCRIPTION OF THE PREFERRED EMBODIMENTS

Figure 1:
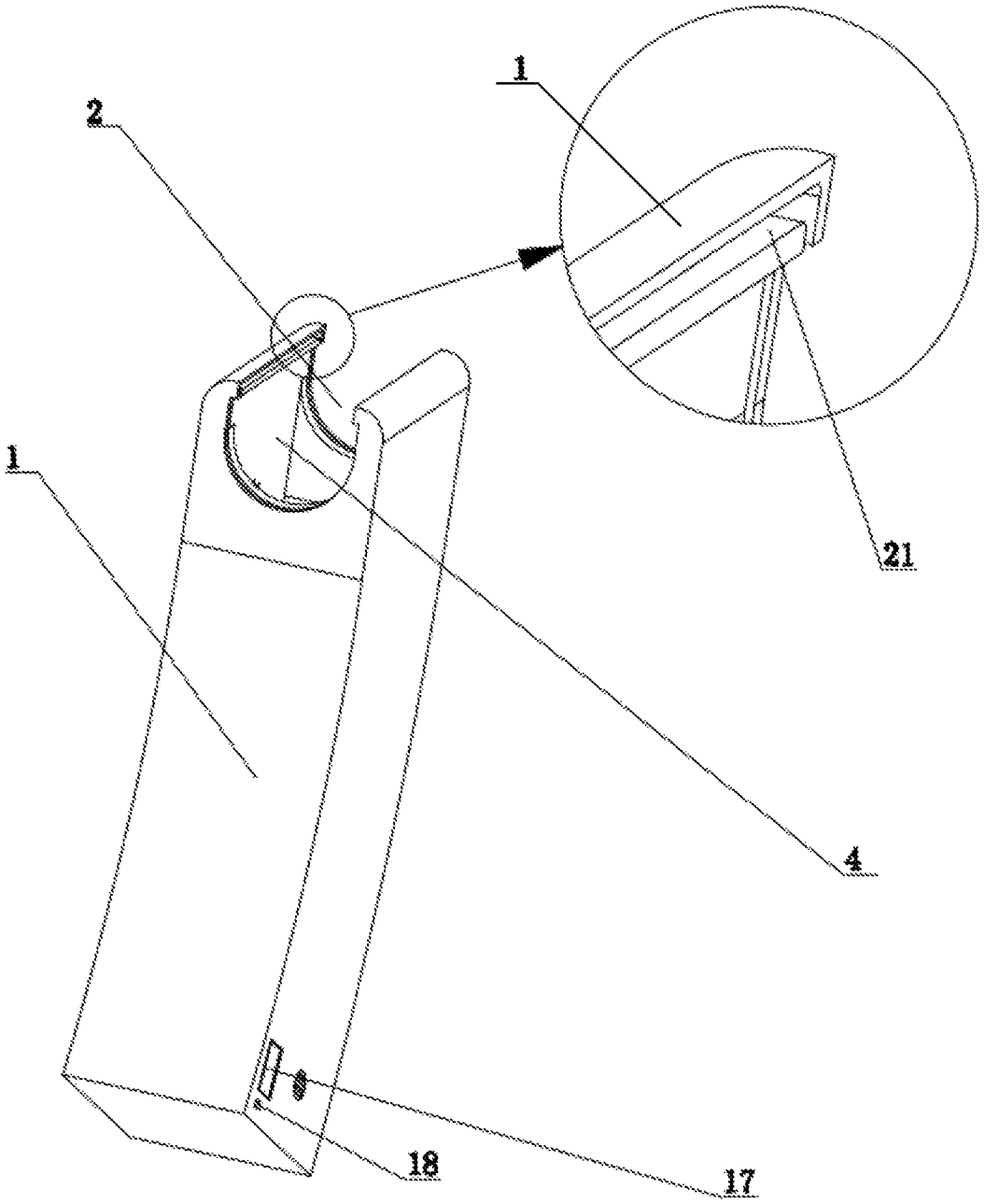
FIG. 1 is a perspective view showing a magazine according to the present invention.
Figure 2:
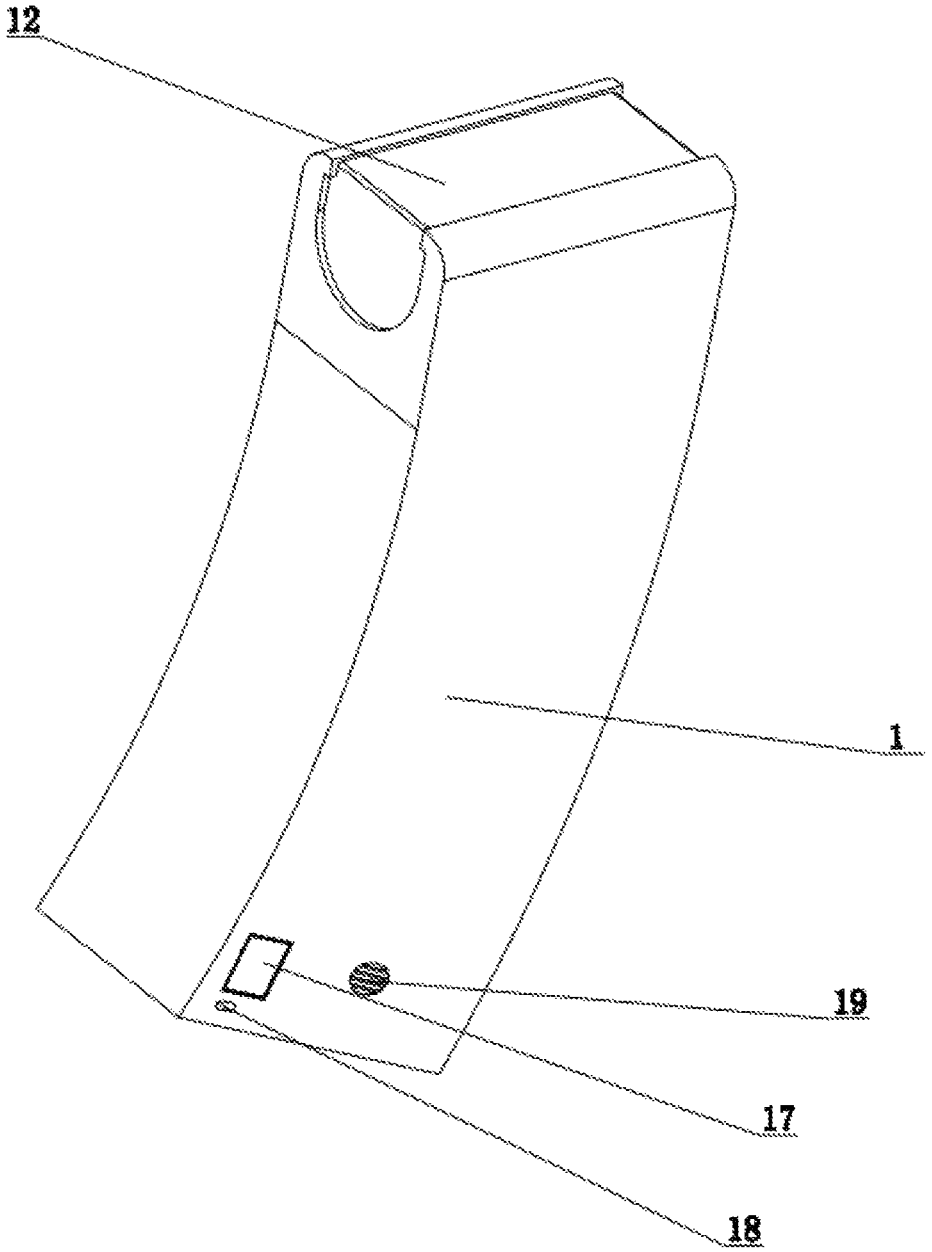
FIG. 2 is a schematic view illustrating a blocked and locked state of the magazine according to the present invention.
Figure 3:
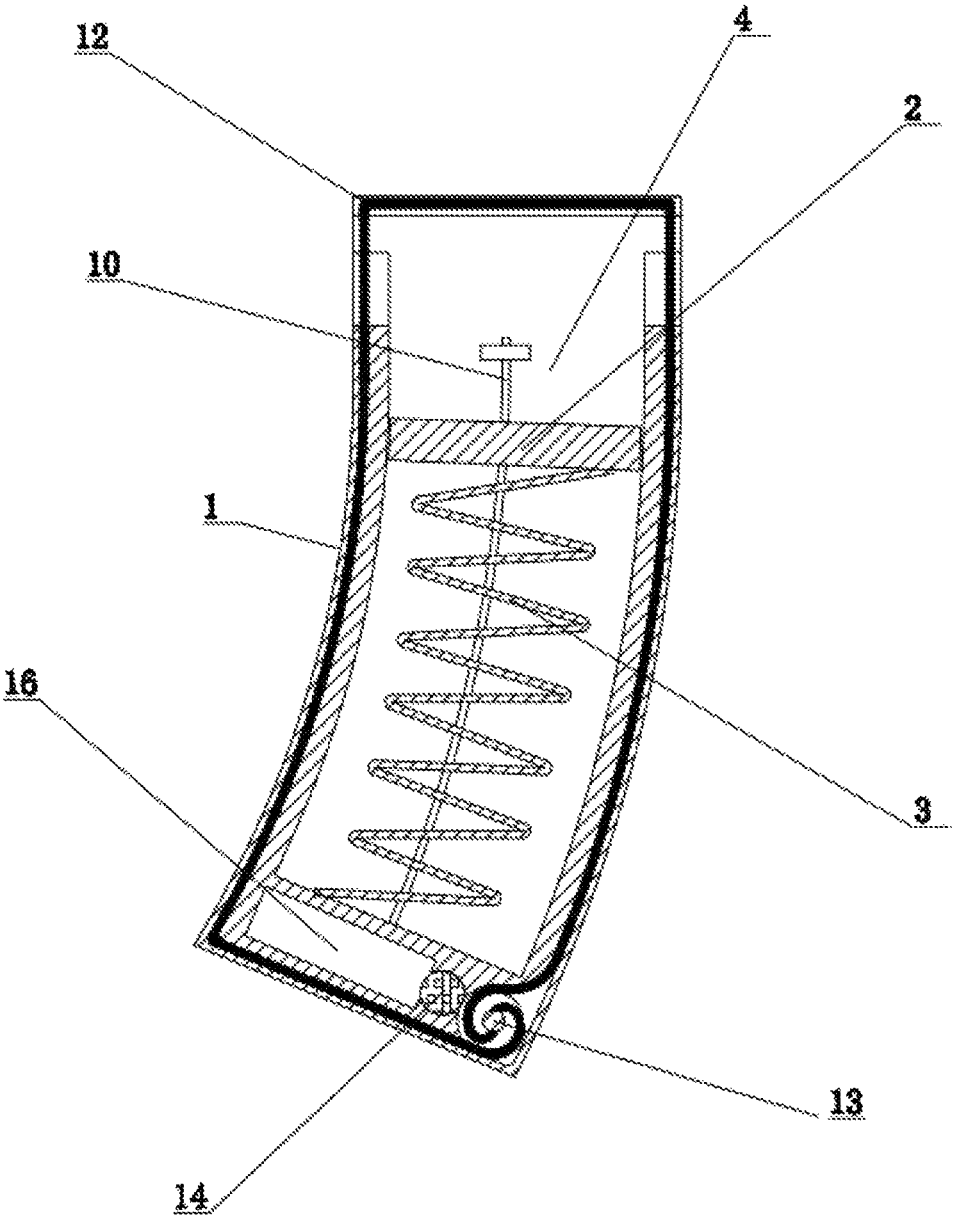
FIG. 3 is a side sectional view of the magazine according to the present invention.

A magazine according to the present invention and an intelligent approval system are shown in FIGS. 1-3. A structure of the magazine comprises a casing 1, and a magazine follower 2, a magazine spring 3, and cartridge chamber 4 are arranged in an interior of the casing 1. The cartridge chamber 4 is formed, in an upper end thereof, with a cartridge opening 5. The magazine spring 3 is arranged at a bottom position of the cartridge chamber 4. The magazine follower 2 is arranged on an upper end position of the magazine spring 3. To load cartridges, the cartridges are inserted through the cartridge opening 5 into the interior of the cartridge chamber 4, and the magazine follower 2 follows the loading of the cartridges to gradually descend, and after fully loading of the cartridges, the magazine follower 2 is located at a lowest end.

For the US market, the situation that firearms can be freely use makes innocent firearm injury cases occurring in the US every year. This is obviously an event that jeopardizes life safety of the public. Therefore, to suppress mistaken uses of firearms to limit the occurrence of firearm shooting issues, considering the complicated society situation in the US, improvement designs of the firearm magazine are so made as to modify the entire structure thereof in order to achieve an effect of constraining the use thereof.

As shown in FIG. 2, the cartridge chamber 4 is provided, at a bottom end thereof, with a control module 16, the control module 16 being for controlling cartridge shooting and cartridge loading, and monitoring a cartridge shooting condition, and the magazine of the present invention is provided with a locking mechanism, the locking mechanism being for preventing cartridge loading and outputting (removing cartridges or shooting out cartridges). Here, the control module 16 is for controlling shooting of the cartridges, such that (1) before shooting, unlocking of the control module 16 must be carried out to allow the cartridges in the cartridge chamber 4 to move into the chamber for shooting; (2) cartridge loading is controlled in order to prevent autonomous cartridge loading when the cartridge chamber 4 runs out of cartridges; (3) the cartridge shooting condition is monitored by recording a position of use of the magazine according to the present invention and environmental sound of the use site, while the locking mechanism involves operating components for implementing control of the control module 16 over cartridge shooting and cartridge loading.

The control module 16 comprises a Bluetooth communication module, a fingerprint collection module, a battery module, and a mobile phone side processing module. The Bluetooth communication module and the fingerprint collection module are used to control the locking mechanism to carry out locking or unlocking motion. The battery module is used to provide electrical power need for the Bluetooth communication module and the fingerprint collection module. The Bluetooth communication module comprises a Bluetooth transmitter, a Bluetooth receiver, a communication processing terminal, and a Bluetooth connector. The communication processing terminal is separately connected with the Bluetooth transmitter and the Bluetooth receiver. The fingerprint collection module comprises a fingerprint collection board 17. The fingerprint collection board 17 is connected with the communication processing terminal. The battery module comprises a battery, a battery receiver, and a battery switch terminal. The battery receiver is connected with the communication processing terminal. The battery receiver is connected with the battery switch terminal. The battery switch terminal controls a discharging condition of the battery. The mobile phone side processing module comprises a mobile phone receiver, a mobile phone transmitter, processing software, and mobile phone Bluetooth. The mobile phone Bluetooth is used for connection with the Bluetooth communication module. The processing software receives, through the mobile phone receiver, a signal, and the processing software transmits, through the mobile phone transmitter, a signal.

Figure 7:
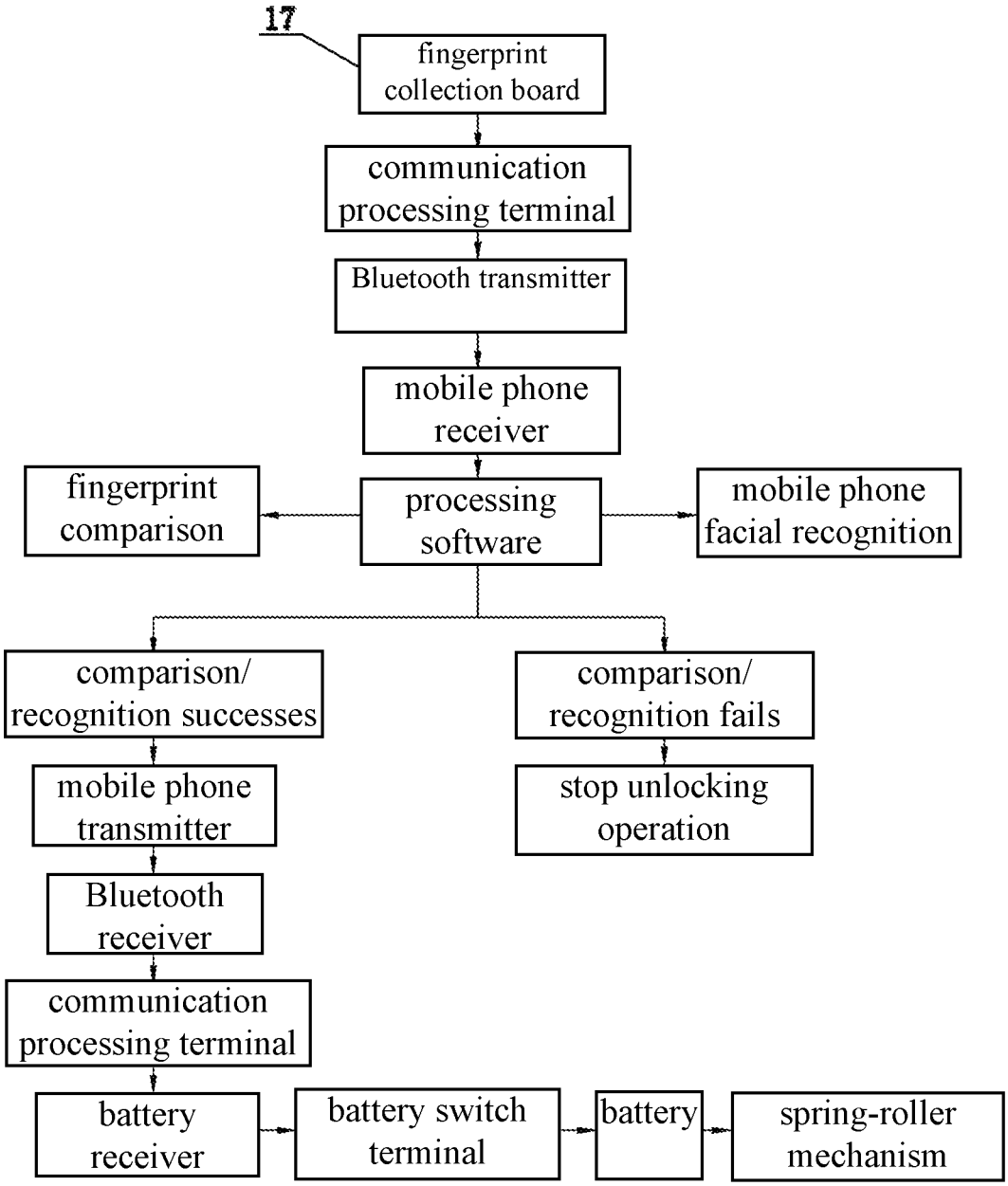
FIG. 7 is a flow chart illustrating a control module controlling a spring-roller mechanism to opening according to the present invention.

For operation steps, firstly, the Bluetooth connector is set in connection with the mobile phone side Bluetooth. As shown in FIG. 7, the fingerprint collection module collects, through the fingerprint collection board 17, a user fingerprint for transmitting to the communication processing terminal to have fingerprint data transmitted through the Bluetooth transmitter to be received and transmitted by the mobile phone receiver to the processing software, so that the processing software compares the fingerprint collected at use with a fingerprint initially recorded in the mobile phone to thereby recognize if the owner is operating the firearm, and further, the processing software may execute a function of facial recognition to identify if the owner is making the operation, and after success of comparison and recognition, the mobile phone transmitter transmits a signal and the Bluetooth receiver receives the signal for transmitting to the communication processing terminal for processing, and transmitting, after completion of the processing a signal to the battery receiver, and upon receipt of the signal, the battery switch terminal controls the battery to positively supply electrical power to the drive motor 14 of a spring-roller mechanism to then control the locking structure to unlock for subsequent operation. The fingerprint collection board 17 of the fingerprint collection module is arranged at a bottom end position of the casing 1, and here, since the styles of the casing 1 are different for different firearms, the location of the fingerprint collection board 17 may vary accordingly, and it only requires the location to be exposed for operation when the casing 1 is being used. For long lasting use of the battery module, the battery module is further provided with a battery charging port 18, and here, the location where the battery charging port 18 is arranged can be set at a bottom of the casing 1. In the above description, the Bluetooth communication module, the fingerprint collection module, and the battery module are all existing technology and further details are omitted herein, and also, the recognition technology of mobile phone processing software and the technology of connection and comparison can all be realized by adopting existing techniques.

The above realizes effects of controlling shooting and loading for cartridges loaded in the magazine, and to further realize implementation of recording of position of use and environmental sound during use, the control module 16 further comprises a GPS positioning module and a black box sound recording module. The GPS positioning module is used for positioning, and the black box sound recording module is used for recording and position information collection. Electrical power consumed by the GPS positioning module and the black box sound recording module are supplied from the battery module. The GPS positioning module comprises a positioning receiver, and the positioning receiver is connected with the communication processing terminal. The black box sound recording module comprises a microphone 19 and a recording storage device. The microphone 19 is separately connected with the recording storage device and the communication processing terminal.

Figure 8:
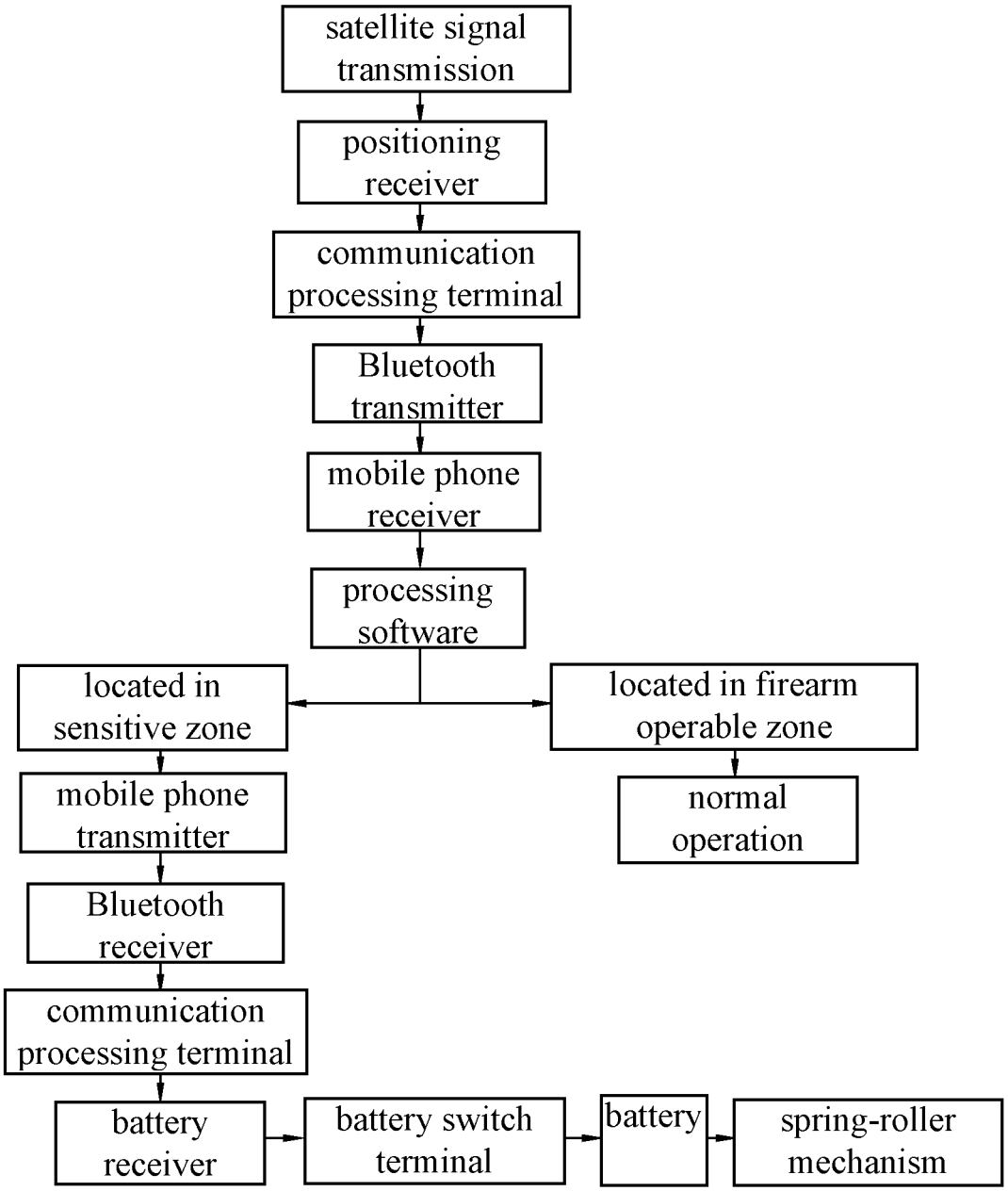
FIG. 8 is a flow chart illustrating operation of a GPS positioning module according to the present invention.
Figure 9:
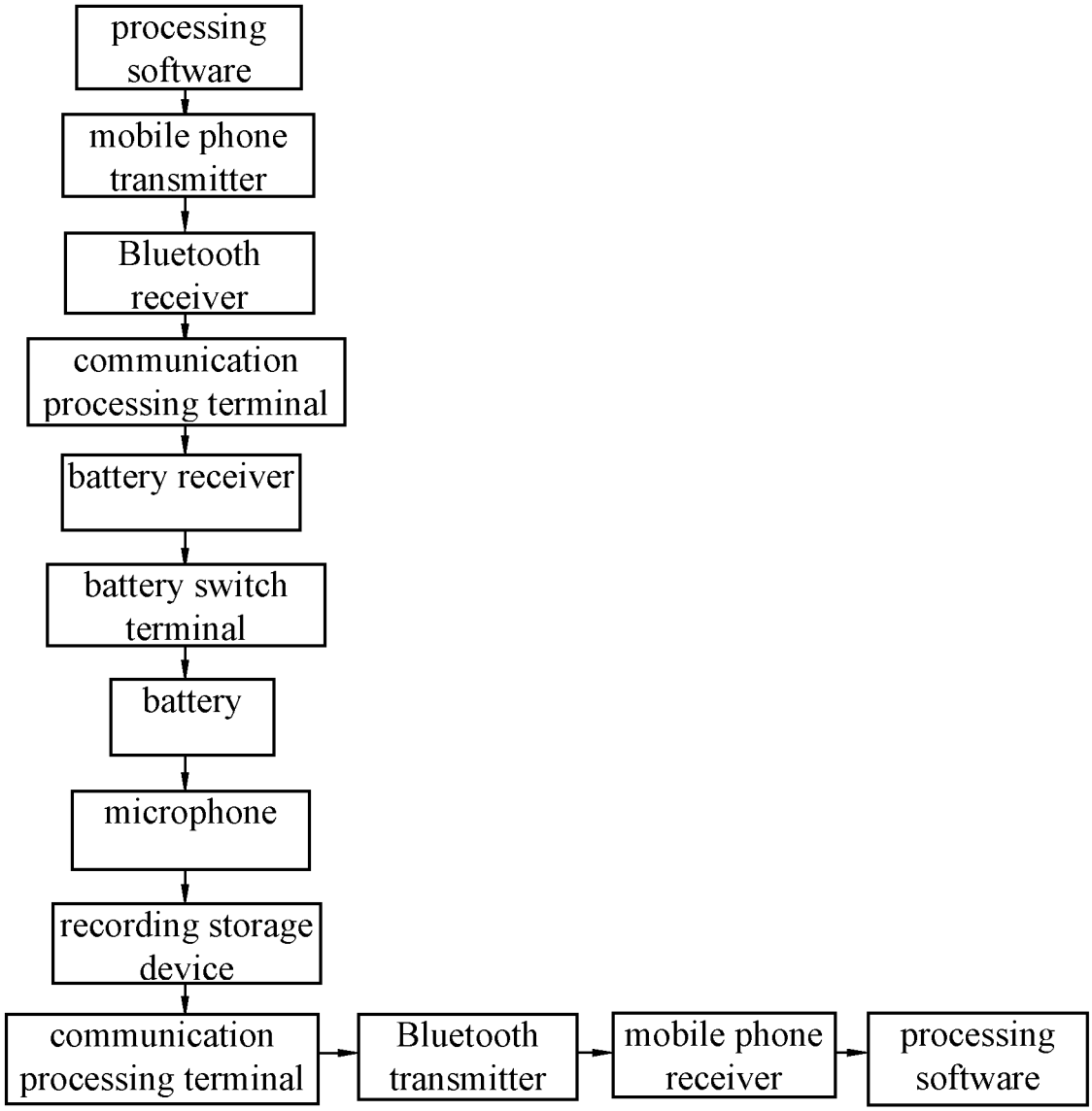
FIG. 9 is a flow chart illustrating operation of a black box sound recording module according to the present invention.

For the modes of operation of the GPS positioning module and the black box sound recording module, the GPS positioning module is connected with the battery module, and the battery module constantly supplies electrical power thereto. As shown in FIG. 8, signals are transmitted from multiple satellites and the positioning receiver performs receipt thereof for transmitting to the communication processing terminal for comprehensive processing, and information that has been so subjected to comprehensive processing is integrated and fed to the Bluetooth transmitter for transmitting to the mobile phone receiver to be supplied from the mobile phone receiver to the processing software for recording processing, and at this moment, the processing software combines map positioning data to inspect whether or not the user is located in a sensitive zone, such as a controlled area and a drone prohibition region, and if located in the sensitive zone, the processing software transmits, by means of the mobile phone transmitter, a signal to the Bluetooth receiver to be transmitted by the Bluetooth receiver to the communication processing terminal, and the communication processing terminal issues a signal of terminating use to the battery receiver to be transmitted by the battery receiver to the battery switch terminal to control the battery to feed a current for reverse rotation to the drive motor 14 of the spring-roller mechanism, so as to lock the magazine for terminating use. As shown in FIG. 9, to save electrical power consumption of the black box sound recording module, it is necessary that after success of unlocking through fingerprint comparison and facial recognition, the processing software issues an activation signal through the mobile phone transmitter to be received by the Bluetooth receiver for transmitting to the communication processing terminal, and the communication processing terminal issues a signal to the battery receiver to be transmitted to the battery switch terminal to control overall electrical power supply from the battery to the black box sound recording module, and the microphone 19 is operable to transmit collected information to the recording storage device, and the recording storage device simultaneously backs up and transmits the data to the communication processing terminal to be transmitted by the communication processing terminal through the Bluetooth transmitter to the mobile phone receiver to be transmitted by the mobile phone receiver transmits to the processing software for backup. In the operation of implementing recording collection, the location of the microphone 19 is at a bottom end position of the casing 1, and a specific location thereof can such that it does not interfere with the recording operation. The arrangement of the GPS positioning module in combination with the black box module can realizes instantaneous recording for the use of the firearm and report of position information to prevent misuse of firearm and to provide clues and evidences to investigation of firearm related cases.

Figure 4:
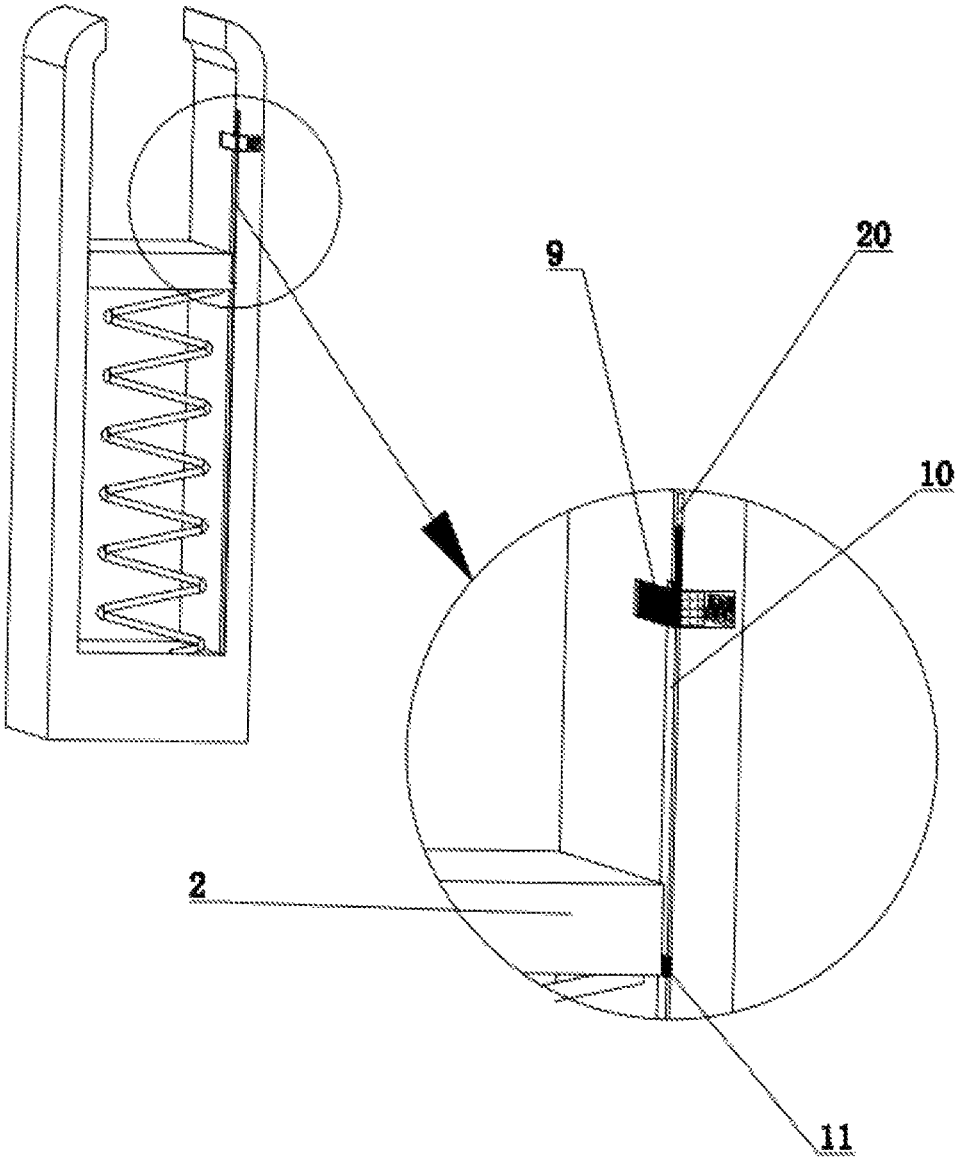
FIG. 4 is a structure diagram of a retaining engagement mechanism according to the present invention.
Figure 5:
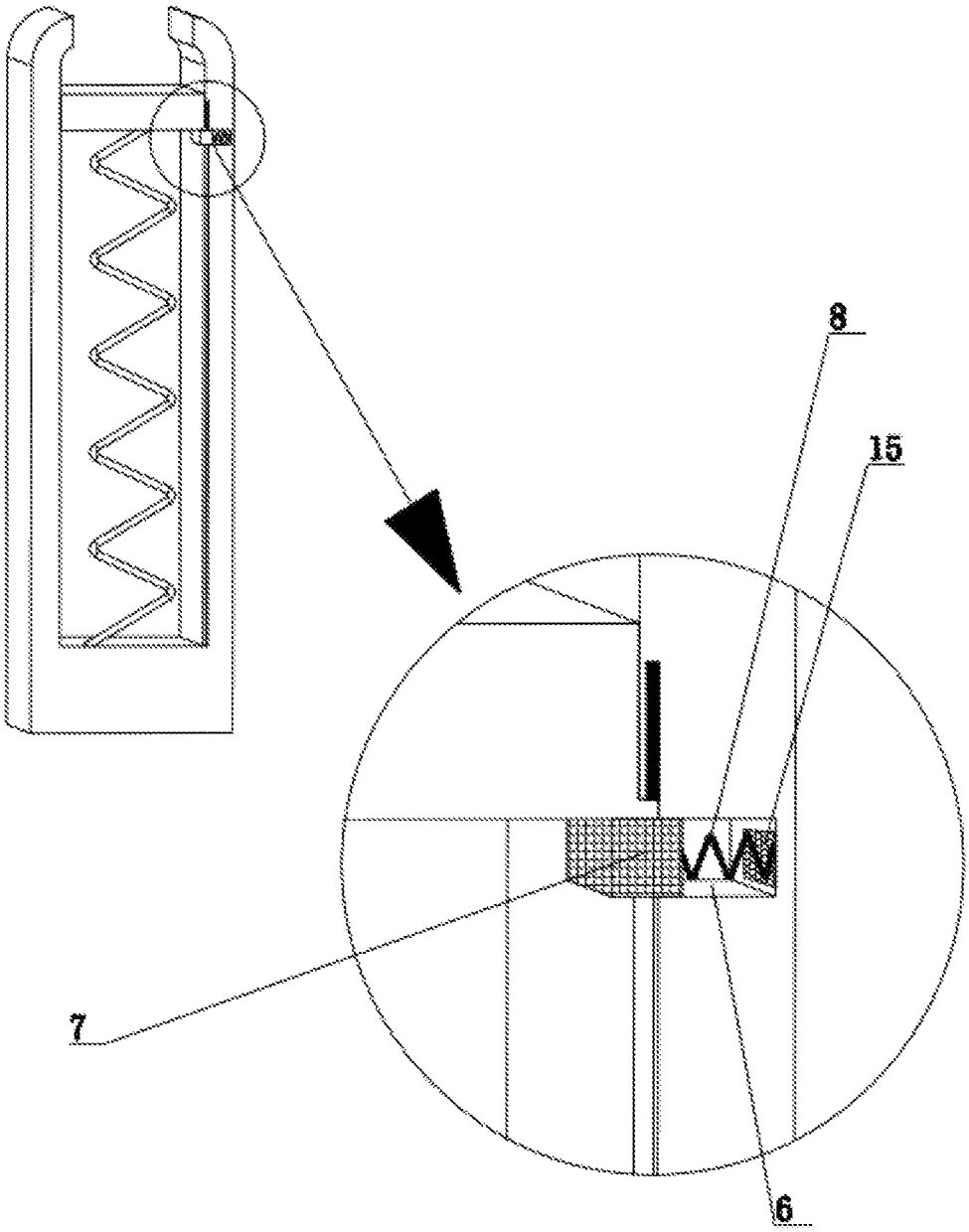
FIG. 5 is a structure diagram of the retaining engagement mechanism continuing from FIG. 4.

The following provides explanation to a specific structure of a locking mechanism of the operating components that realize cartridge shooting and cartridge loading controlled by the control module 16:

The locking mechanism mainly comprises a retaining engagement mechanism and a spring-roller mechanism. The retaining engagement mechanism is arranged on a sidewall of the cartridge chamber 4 at a location adjacent to the cartridge opening 5 to carry out a locking operation on the magazine follower 2, and the specific structure thereof is that, as shown in FIG. 4 or 5, the sidewall of the cartridge chamber 4 is formed with a retaining engagement notch 6, and the retaining engagement mechanism is fit in the retaining engagement notch 6. The retaining engagement mechanism comprises an extendible/retractable retaining pin 7, an extension/compression spring 8, and a lift plate 9. One end of the extension/compression spring 8 acts on a notch bottom of the retaining engagement notch 6 and an opposite end acts on the extendible/retractable retaining pin 7. The lift plate 9 is located at a position of notch opening of the retaining engagement notch 6 and is movable upward/downward relative to the retaining engagement notch 6 to realize opening and closing of the notch opening of the retaining engagement notch 6. The arrangement of the retaining engagement structure here provides an effect of prohibiting performance of a cartridge loading operation into the magazine after the cartridge chamber 4 runs out of the cartridges loaded therein. Thus, the retaining engagement mechanism here also needs to arrange in combination with the magazine follower 2. The sidewall of the cartridge chamber 4 is formed with a movement groove 10, and the movement groove 10 is arranged to correspond to an ascending path of the magazine follower 2. A side surface of the magazine follower 2 is provided with a driving block 11 corresponding to the movement groove 10. The driving block 11 is used to drive the lift plate 9 to perform an ascending motion. In summarization of the above description, to prevent the lift plate 9 from being dragged by the continuously ascending cartridge due to friction to affect the effect of constraining to the magazine follower 2, the lift plate 9 is uniquely arranged, and s shown in FIG. 4, a receiving groove 20 is formed in a sidewall of the retaining engagement notch 6 at a location above the notch opening, and the lift plate 9 is located in the receiving groove 20. At this moment, the entirety of the lift plate 9 is slightly fit into the retaining engagement notch 6 and not in contact with the cartridges, and is thus not affected. Also, for the position of the entirety of the retaining engagement mechanism, the location thereof under the condition of no cartridge loaded is at a lower end position of the magazine follower 2, and an upper end edge of the retaining engagement notch 6 abuts a lower end edge of the magazine follower 2, and the driving block 11 of the magazine follower 2 is fit in the movement groove 10, and a length of the driving block 11 is sufficient to lift up the lift plate 9, and also, here, a bottom end face of the driving block 11 is flush with a bottommost end face of the magazine follower 2. This stops operation of autonomous cartridge loading after the cartridge chamber 4 gets empty, and to describe with reference to FIG. 4, it needs to first appreciate that in the initial state of the retaining engagement structure, the extendible/retractable retaining pin 7 is fully disposed in the retaining engagement notch 6, and the extension/compression spring 8 is in a compressed state, and the lift plate 9, due to the effect of gravity, blocks the notch opening of the retaining engagement notch 6 at this moment, suppressing outwards ejection of the extendible/retractable retaining pin 7. As shown in FIG. 5, with the cartridges inside the cartridge chamber 4 being gradually consumed, the magazine follower 2 rises and moves upward correspondingly, and the driving block 11 of the magazine follower 2 moves upward with the movement groove 10, and when the cartridge are about to run out, with only one or two left, the upper end face of the driving block 11 becomes gradually getting abutting with the lower end face of the lift plate 9, and with the final one of the cartridges being shot, the magazine follower 2 rises to the topmost end position, and at this moment, the lift plate 9 is elevated by the driving block 11, and the lift plate 9 completely gets into the receiving groove 20, and at this moment, the notch opening of the retaining engagement notch 6 is fully opened, no longer constraining the extendible/retractable retaining pin 7 and the extension/compression spring 8, and at this moment, the extension/compression spring 8 is caused by the spring characteristics thereof to spring back to eject the extendible/retractable retaining pin 7 out of the retaining engagement notch 6, making the extendible/retractable retaining pin 7 retaining the lower end face of the magazine follower 2, and at this moment, it is not possible to dispose cartridges into the cartridge chamber 4. Also, for a bettered arrangement for the above-described retaining engagement that locks up the magazine follower 2 for not proceeding with cartridge loading, two sets of such an arrangement may be provided and the two sets are arranged opposite to each other.

Figure 10:
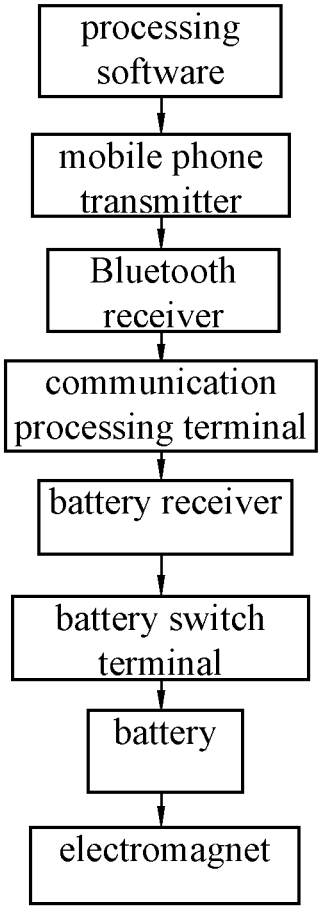
FIG. 10 is a flow chart illustrating operation of cartridge loading implemented according to the present invention.

For the retaining engagement mechanism, based on the idea of further considering the entirety of the device, it is that after the magazine has been completely used up, for purchasing of magazines, a way of traveling to a designated sale point to redeem a cartridge-loaded and enclosed magazine is adopted, and at the time of purchase, the sale side encodes the newly purchased magazine by means of an APP system to provide the client with authorization for use, and the used magazine is then returned and recovered, and the record in the returned and recovered magazine is cleared off and operation of reloading cartridge is taken on the magazine through designated authorization of the APP, and the way of operation is that authorization is acquired through mobile phone APP software by having the Bluetooth communication module receiving a signal to proceed with the operation and the specific structure operation way is that as shown in FIG. 5, an electromagnet 15 is arranged at a notch bottom position of the retaining engagement notch 6, and as shown in FIG. 10, the battery module is set in connection therewith through a means of electrical wire, and the processing software issues an authorization signal to transmit, through the mobile phone transmitter, to the Bluetooth receiver to be subsequently transmitted to the communication processing terminal, and the communication processing terminal issues a signal to the battery receiver, and then, the battery switch terminal controls the battery to supply electrical power to the electromagnet 15 to induce magnetism on the electromagnet 15, and also, here, the extendible/retractable retaining pin 7 and the extension/compression spring 8 are both metallic products and the magnetic attraction force makes the extendible/retractable retaining pin 7 that originally extends out of the retaining engagement notch 6 attracted back into the retaining engagement notch 6, and at this moment, operation of cartridge loading may proceed and with the loading of cartridges, the magazine follower 2 starts to descend and the driving block 11 no longer lifts and supports the lift plate 9, making the lift plate 9 descending with the gravity, and here, it is possible to arrange a small spring on an upper end of the lift plate 9, two ends of the small spring respectively connected to the top end of the receiving groove 20 and the top end of the lift plate 9 to better help the lift plate 9 to descend to thereby block the notch opening of the retaining engagement notch 6.

The above structure is an arrangement for blocking cartridges from being loaded, and now, an explanation is given to a specific structure of the spring-roller mechanism, of which the function is to collaborate with the control module 16 for controlling shooting of cartridges. The spring-roller mechanism comprises a movable detachment-prevention retaining spring 12, a retaining spring recovering roller 13, and a drive motor 14. As shown in FIG. 3, the movable detachment-prevention retaining spring 12 is looped around a peripheral position of the cartridge chamber 4, and a trough 21 is arranged between the casing 1 and the sidewall of the cartridge chamber 4, and the trough 21 corresponds to the movable detachment-prevention retaining spring 12. The retaining spring recovering roller 13 is rotatably disposed at a bottom end position of the cartridge chamber 4, and the movable detachment-prevention retaining spring 12 is arranged to partly wrap around a radial surface of the retaining spring recovering roller 13, and here, the style of combination between the movable detachment-prevention retaining spring 12 and the retaining spring recovering roller 13 is just like a structure style of a flexible rule, and an output end of the drive motor 14 is connected, through a toothed wheel structure, with an axle end of the retaining spring recovering roller 13.

Figure 6:
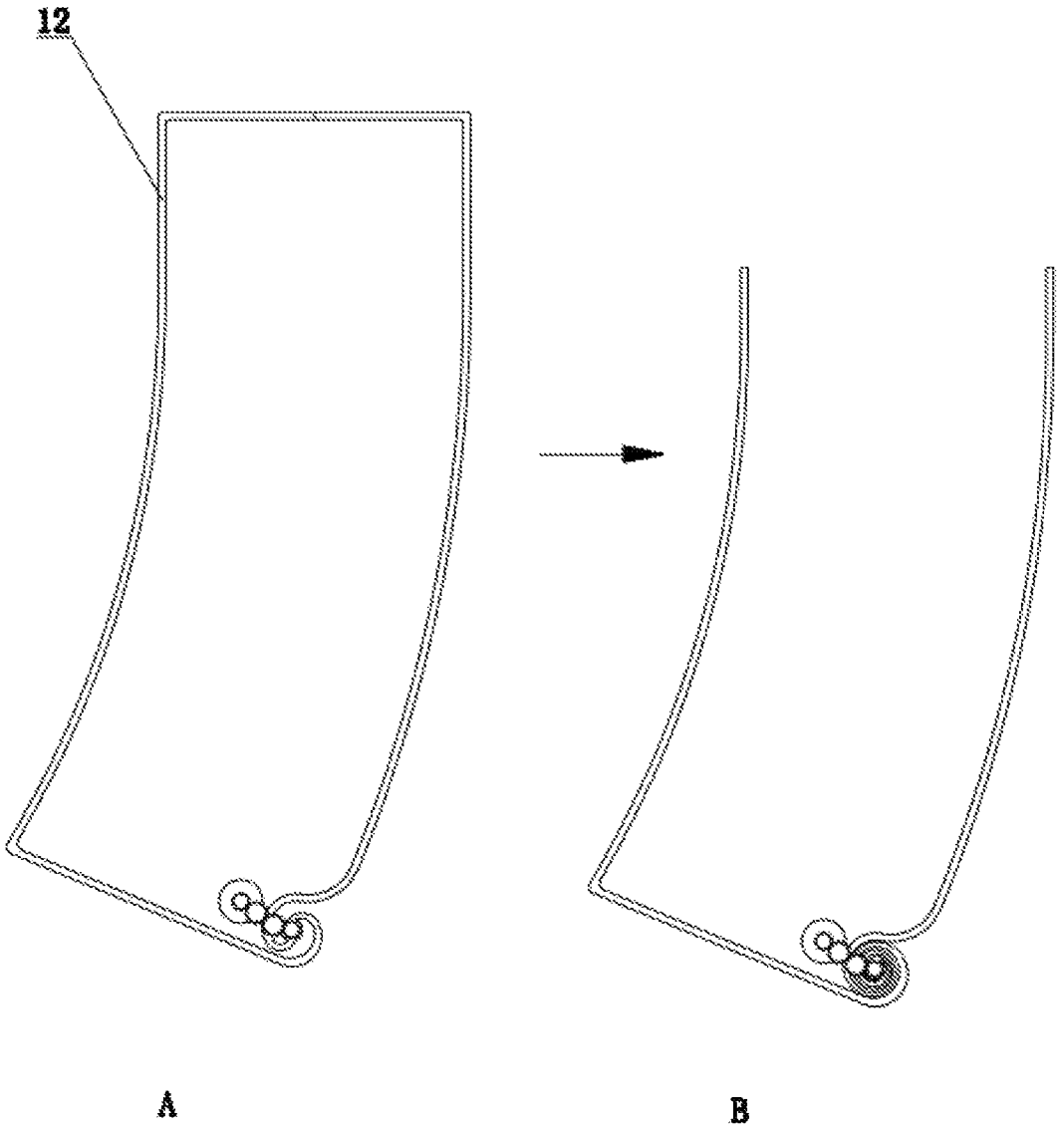
FIG. 6 is a schematic view showing operation of a spring-roller mechanism according to the present invention.
Figure 11:
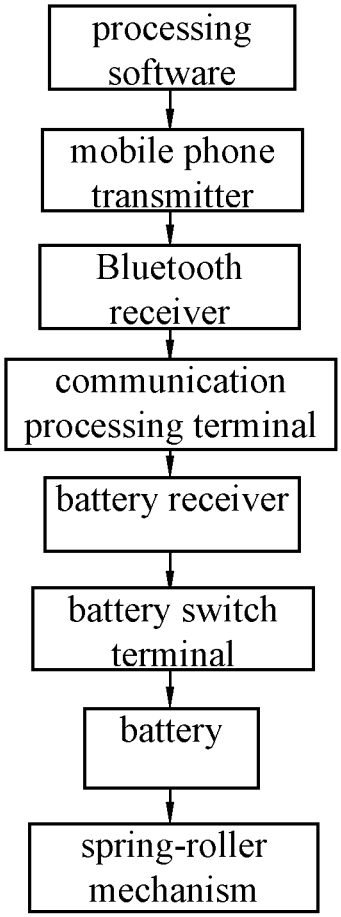
FIG. 11 is a flow chart illustrating operation of a time counting program according to the present invention.

In case of being not in use, the movable detachment-prevention retaining spring 12, in the entirety thereof, surrounds a full circumference of the cartridge chamber 4 and the casing 1 as shown in Part A of FIG. 6, so as to block the cartridge opening 5 and prevent the cartridges from being pushed upward to enter the chamber, and at this moment, it is not possible to proceed with shooting. As shown in FIG. 7, to proceed with operation of shooting, it is necessary to complete the above-described fingerprint comparison with the fingerprint collection module and facial recognition with the processing software, and once past, the mobile phone side issues a signal toward the Bluetooth communication module, and the Bluetooth communication module, receiving feedback of the signal, controls the battery module to supply electrical power to the drive motor 14 for forward rotation, so that, as shown in Part B of FIG. 6, the retaining spring recovering roller 13 is caused to rotate to wind up the movable detachment-prevention retaining spring 12, and the movable detachment-prevention retaining spring 12 moves along the trough 21, and the rotation stops once the rotation reaches a specified location, and at this moment, the cartridge opening 5 is open so that the magazine is allowed to insert into a firearm for use. As shown in FIG. 11, also, after opening with the movable detachment-prevention retaining spring 12, the processing software activates a time counting program and when the time reaches a specified value, the processing software transmits a signal through the mobile phone transmitter to the Bluetooth receiver, and transmitting, at this moment, to the communication processing terminal, to get signal feedback to issue a signal to the battery receiver to make the battery switch terminal controlling the battery to electrical power to the drive motor 14 for reversed rotation to control the retaining spring recovering roller 13 to proceed with reversed rotation, causing the movable detachment-prevention retaining spring 12 to remove along the trough 21 to block the cartridge opening 5, and shooting is no longer possible at this moment, and it requires performing operation of unlocking again. Further, in view of the possibility that unauthorized violent disassembling may be applied to the movable detachment-prevention retaining spring 12, a pressure sensor is arranged on the axle of the retaining spring recovering roller 13, and the pressure sensor is connected with the Bluetooth communication module, when unauthorized violent disassembling is taken on the movable detachment-prevention retaining spring 12, a pressure induced thereby acts on the retaining spring recovering roller 13, and at time moment, the pressure sensor detects it and proceed with reporting to the police by means of the Bluetooth communication module.

Further, in view of the situation that there may be cartridges remaining after shooting, and at this moment, the user may personally do unlocking to open the movable detachment-prevention retaining spring 12 to proceed with loading of cartridges, and at this moment, due to the driving block 11 on the magazine follower 2 not opening the lift plate 9, making the extendible/retractable retaining pin 7 not retain the magazine follower 2 and the cartridge loading operation is performable, thus, a depression sensor may be arranged on the magazine follower 2, and the depression sensor is connected with the Bluetooth communication module, and thus excluding the situation of cartridge loading with authorization, in other situations, after the magazine follower 2 induces a depression force, the depression sensor transmits a signal to the Bluetooth communication module, and the Bluetooth communication module, upon receiving the signal, controls the battery module to supply electrical power to the drive motor 14 for reversed rotation so as to control the retaining spring recovering roller 13 to reversely rotate to make the movable detachment-prevention retaining spring 12 to re-move along the trough 21 to block the cartridge opening 5 and preventing the operation of cartridge loading.

Figure 12:
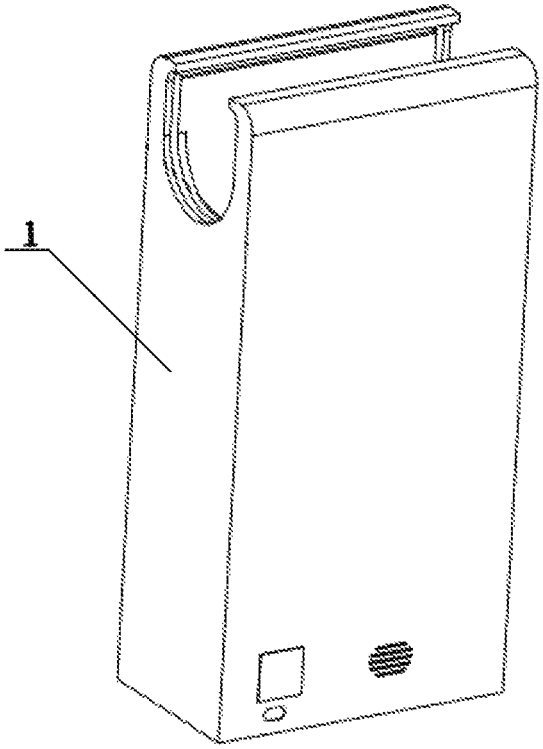
FIG. 12 is a magazine of a rectangular structure.
Figure 13:
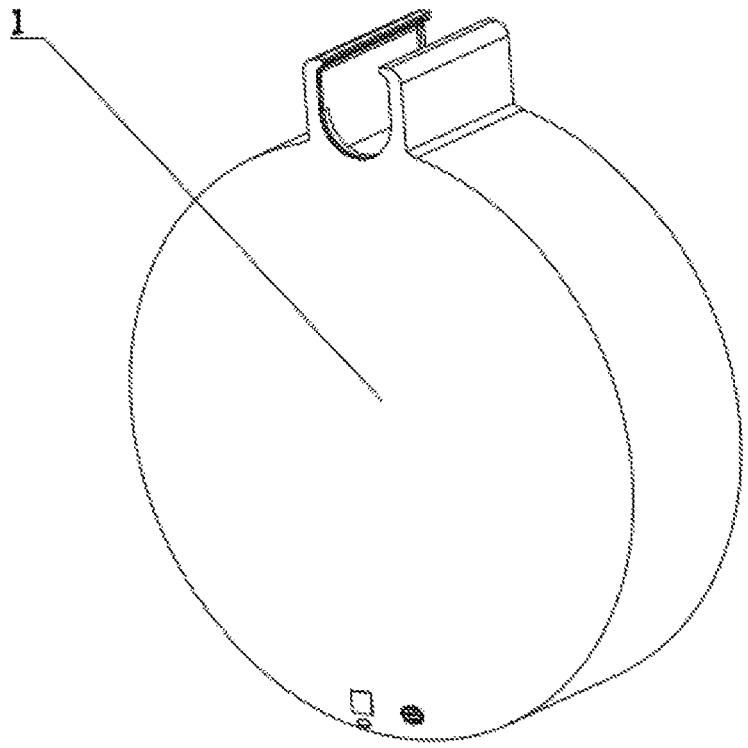
FIG. 13 is a magazine of a circular structure.

In summary:

By taking intelligent approval operation before operation, the present device realizes an effect of constraining use of cartridges, so as to reduce the occurrence of gun shooting events, and also, further, after the use of the cartridges, it needs to bring the magazine of the present invention to redeem another magazine, and the redemption personnel check the situation of use of the firearm through the recorded contents in the black box module to thereby determine whether or not to allow the user to redeem the magazine, and in case of law violation and keeling, the redemption personnel may not proceed with the redemption of the magazine and makes reports to the police. Also, the firearm recognition function is only usable by an individual in order to prevent issues of the firearm being used by other persons and thus avoid problems of evidence fabrication and ensure that the cartridge is not removed. Further, the GPS positioning module may explain a firearm owner can quickly find and retrieve the lost firearm. Through combination of the above efficacy effects, the present device can be further bettered by making statistical calculation of data implemented with an intelligent Internet of Things (IoT), in combination with recording by means of the recording function of the black box and recognition and surveillance of the mobile phone side for determining the situation of use, for identifying whether the user attempts to commit suicide in order to prohibit operation of the cartridge. And, the structure of the present device is suitable for arrangement in magazines of various shapes and structures, provided it only needs to modify the shape of the movable detachment-prevention retaining spring 12 of the spring-roller mechanism, and is applicable to for example many shapes, such as arc, circular, and rectangular, as shown in FIGS. 12 and 13.

The way of operation:

S1, pressing the Bluetooth connector on the casing 1 to open connection with the mobile phone Bluetooth;

S2, using the fingerprint collection board 17 to collect a user fingerprint for transmission to the communication processing terminal;

S3, using the Bluetooth transmitter to transmit out fingerprint data, and upon receiving, the mobile phone receiver transmitting to the processing software, and the processing software proceeding with comparison of the fingerprint collected in use with a fingerprint initially recorded in the mobile phone, and the processing software also carrying out a function of facial recognition, recognition and comparison being successfully implemented;

S4, the mobile phone transmitter transmitting a signal and the Bluetooth receiver receiving the signal to transmit to the communication processing terminal for proceeding with processing;

S5, after the processing, transmitting a signal to the battery receiver, and upon receiving the signal, the battery switch terminal controlling the battery to supply electrical power to the drive motor 14 of the spring-roller mechanism for forward rotation;

S6, the drive motor 14 performing forward rotation, the retaining spring recovering roller 13 proceeding with retrieving through rotation, the movable detachment-prevention retaining spring 12 moving along the trough, and cartridges being exposed at the position of the cartridge opening 5 for use;

S6, inserting entirety of the magazine into a firearm, and at the same time, the processing software executing a time counting program;

S7, after time counting reaches a predetermined value, the processing software transmitting a signal through the mobile phone transmitter;

S8, the Bluetooth receiver receiving the signal to transmit to the communication processing terminal;

S9, the communication processing terminal transmitting a signal to the battery receiver to be transmitted by the battery receiver to the battery switch terminal to control the battery to supply electrical power to the drive motor 14 of the spring-roller mechanism for reversed rotation; and S10, the drive motor 14 proceeding with the reverse rotation, and the retaining spring recovering roller 13 performing reverse rotation for releasing, the movable detachment-prevention retaining spring 12 moving along the trough to block the position of the cartridge opening 5.

I claim:

1. A magazine, comprising:

a cartridge chamber, which has an upper end in which a cartridge opening is formed, the cartridge chamber receiving a plurality of cartridges loaded in an interior thereof;

a magazine spring, which is located at a bottom position of the cartridge chamber;

a magazine follower, which is located at an upper end position of the magazine spring;

a casing, which encloses the cartridge chamber, the magazine spring, and the magazine follower; and a locking mechanism, which is arranged on a sidewall of the cartridge chamber and between the casing, the locking mechanism being operable to block and lock the cartridge opening, so as to prevent loading and outputting of the cartridges.

2. The magazine according to claim 1, wherein the locking mechanism comprises a retaining engagement mechanism and a spring-roller mechanism, the retaining engagement mechanism being arranged on a sidewall of the cartridge chamber at a location adjacent to the cartridge opening for performing locking of the magazine follower, the spring-roller mechanism being arranged on an internal sidewall of the cartridge chamber for performing blocking and locking on a position of the cartridge opening.

3. The magazine according to claim 2, wherein a retaining engagement notch is arranged in the sidewall of the cartridge chamber, the retaining engagement mechanism being entirely fit in an interior of the retaining engagement notch, the retaining engagement mechanism comprising an extendible/retractable retaining pin, an extension/compression spring, and a lift plate, one end of the extension/compression spring acting on a notch bottom of the retaining engagement notch, an opposite end acting on the extendible/retractable retaining pin, the lift plate being located at a position of notch opening of the retaining engagement notch and being movable upwards/downwards relative to the retaining engagement notch.

4. The magazine according to claim 3, wherein a movement groove is arranged in the sidewall of the cartridge chamber, the movement groove being arranged to correspond to an ascending path of the magazine follower, a driving block being arranged on a side surface of the magazine follower to correspond to the movement groove, the driving block being operable to drive the lift plate to proceed with an ascending motion.

5. The magazine according to claim 3, wherein an electromagnet is arranged at a position of a notch bottom of the retaining engagement notch.

6. The magazine according to claim 2, wherein the spring-roller mechanism comprises a plurality of movable detachment-prevention retaining springs, a retaining spring recovering roller, and a drive motor, the movable detachment-prevention retaining springs surrounding a circumference position of the sidewall of the cartridge chamber, a trough being arranged between the casing and the sidewall of the cartridge chamber, the trough corresponding to the movable detachment-prevention retaining springs, the retaining spring recovering roller being rotatably arranged at a bottom end position of the cartridge chamber, the movable detachment-prevention retaining springs partly located on and wrapping around a radial surface of the retaining spring recovering roller, an output end of the drive motor being connected, by means of at least one toothed wheel structure, with an axle end of the retaining spring recovering roller.

7. The magazine according to claim 6, wherein a pressure sensor is arranged on an axle of the retaining spring recovering roller.

8. An intelligent approval system, which is connected with the magazine according to claim 1, comprising a control module, the control module being arranged at a bottom end of the cartridge chamber, the control module being used for controlling shooting of the cartridges and loading of the cartridges, and for monitoring a shooting condition of the cartridges.

9. The intelligent approval system according to claim 8, wherein the control module comprises a Bluetooth communication module, a fingerprint collection module, a battery module, and a mobile phone side processing module, the fingerprint collection module being operable to collect at least one fingerprint, the Bluetooth communication module being connected with the fingerprint collection module to transmit the fingerprint to the mobile phone side processing module, the battery module being electrically connected with the Bluetooth communication module and the fingerprint collection module.

10. The intelligent approval system according to claim 9, wherein the control module further comprises a GPS positioning module and a black box sound recording module, the GPS positioning module being operable for positioning, the black box sound recording module being operable for sound recording and position information collecting.

* * * * *